US005562175A

United States Patent [19]

Björsne et al.

[11] Patent Number: 5,562,175

[45] Date of Patent: Oct. 8, 1996

[54] STEERING SYSTEM FOR A SURFACE COMPACTING MACHINE

[75] Inventors: Mats Björsne, Lyckeby; Bo Svensson, Karlskrona, both of Sweden

[73] Assignee: Dynapac Heavy Equipment AB, Karlskrona, Sweden

[21] Appl. No.: 380,348

[22] Filed: Jan. 27, 1995

[30] Foreign Application Priority Data

Jan. 31, 1994 [SE] Sweden ..... 9400290

[51] Int. Cl.[6] ..... B62D 5/08

[52] U.S. Cl. ..... 180/419; 180/20; 180/900; 180/420; 404/126

[58] Field of Search ..... 180/321, 20, 140, 180/900, 139, 134, 135; 404/126

[56] References Cited

U.S. PATENT DOCUMENTS 3,856,102 12/1974 Queen ..... 180/140
3,868,194 2/1975 Ferguson et al. ..... 180/20
4,043,422 8/1977 Barrett et al. ..... 180/140
4,109,742 8/1978 Fairchild et al. ..... 180/20
5,269,389 12/1993 Tomiyoshi et al. ..... 180/139

FOREIGN PATENT DOCUMENTS 229449 11/1985 German Dem. Rep. .

*Primary Examiner*—Anne Marie Boehler
*Assistant Examiner*—Victor E. Johnson
*Attorney, Agent, or Firm*—Walter Ottesen

[57] ABSTRACT

The invention relates to a dual steering system for a tandem-type surface compacting machine equipped with two independent steering modes, for example, a machine equipped with both frame steering (3) and with individual steering (6) of one of the rollers (4*a*). The invention provides a control of both systems, one enabled by a steering-wheel activated steering valve (11) and the other enabled by a joystick-activated control valve ( 12). The control valve ( 12) is operatively connected to the switching valves (14*a* to 14*d*) which are activated with an electric switch in such a way that the machine operator can instantly select the steering mode whose activation with the steering wheel or joystick he deems most appropriate at any given time.

3 Claims, 3 Drawing Sheets

STEERING SYSTEM FOR A SURFACE COMPACTING MACHINE

FIELD OF THE INVENTION

The invention relates to a steering system for a tandem-type surface compacting machine equipped with two independent steering modes, that is, a system in which either the leading or trailing roller can be individually steered. A steering system of the kind referred to above is disclosed in U.S. Pat. No. 3,868,194, or a system permitting frame steering or individual steering of one of the rollers

BACKGROUND OF THE INVENTION

Rollers of this type are usually steered via a steering-wheel activated hydraulic control valve which controls the flow of fluid to steering cylinders. Actuation of a switching valve permits selection of the desired steering cylinder, either the cylinders actuating the leading roller or the trailing roller or, in the second instance, the cylinders actuating frame steering or one of the rollers.

SUMMARY OF THE INVENTION

It is an object of the invention to provide simultaneous control of both systems, one of which by means of a steering-wheel activated control valve or steering valve and the other by means of a control device, such as a joystick acting on an electrically operated control valve, arranged, via changeover valve means including switching valves which can be set with an electric switch, in such a way that the operator can instantly select the steering system whose operation with the steering wheel or joystick he deems most appropriate at any given moment. The steering-wheel activated steering valve has a capacity, appropriate to the roller size in question, by which the steering speed is affected by the speed with which the wheel is turned, and the joystick-activated steering valve is equipped with a throttle providing slower, smoother steering.

A frame-steered surface compacting machine is normally steered by having the steering wheel, via its control or steering valve, actuate frame steering, in which the rollers track in tandem because of the frame steering. If a larger effective rolling width is desired, that is, when the rollers are arranged in echelon, individual steering of one of the rollers can be actuated with the joystick so the roller rotates. When this occurs with the vehicle in motion, the surface compacting machine turns. The steering wheel, which acts on the frame steering, is then rotated to compensate for the turn and maintain a straight course, and the rollers are laterally shifted in one desired direction or the other. The steering valve activated by the joystick can also be used for steering the surface compacting machine during normal operation and then acts on the individually steerable roller. The steering geometry is then effected so the rollers do not track in the same way as in frame steering. This is a major advantage in various tasks, for example, when the machine closely skirts a curbstone or when a cutting tool is mounted on one of the rollers.

The machine operator can instantly select the steering system most appropriate for activation with the steering wheel or joystick at any given moment.

BRIEF DESCRIPTION OF THE DRAWINGS

The invention will now be described with reference to the drawings, wherein.

DESCRIPTION OF THE PREFERRED EMBODIMENTS OF THE INVENTION

Figure 1:
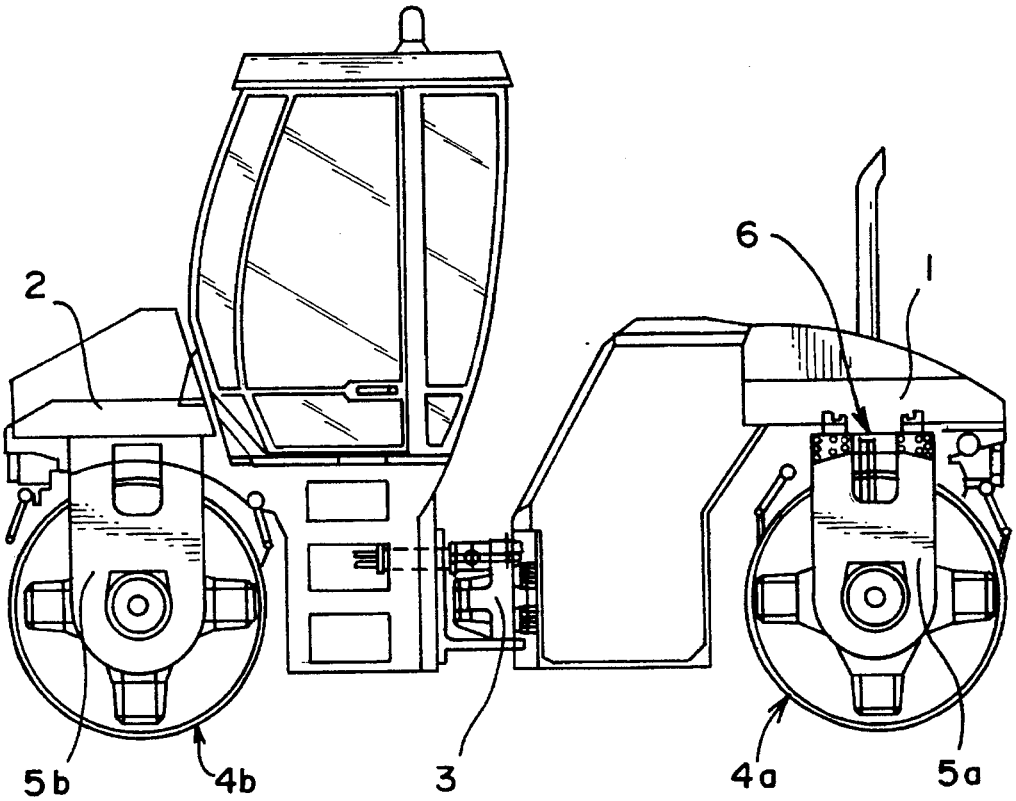
FIG. 1 is a side elevation view of an embodiment of a tandem surface compacting machine according to the invention.

In FIG. 1, the trailing frame section 1 is connected to the leading frame section 2 by the frame steering link 3. The trailing roller 4*a* of the surface compacting machine is carried in a roller frame 5*a* which is rotatingly journalled in the bearing 6 in the trailing frame section 1. The leading roller 4*b* is carried in the roller frame 5*b* which is fixedly attached to the leading frame section 2.

Figure 2:
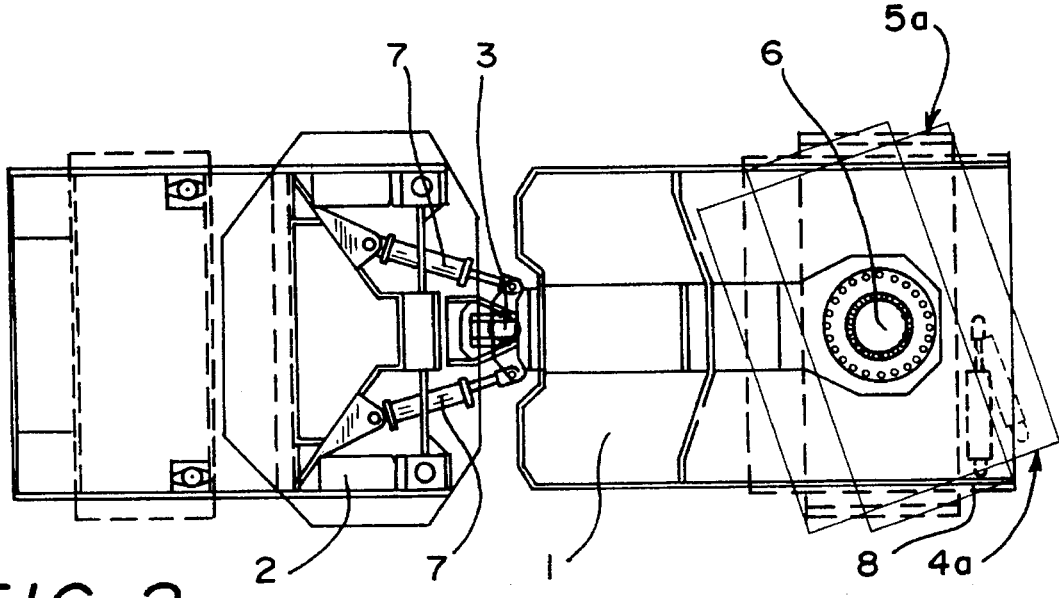
FIG. 2 is a plan view of the compacting machine of FIG. 1 showing the following: a frame steering joint, an individual steering joint on one of the rollers and steering cylinders.

FIG. 2 shows a first hydraulic steering assembly including the steering cylinders 7 which provide frame steering via the frame articulation link 3 and a second hydraulic steering assembly including the steering cylinder 8 which acts on the roller frame 5*a* to effect steering about bearing 6 relative to frame section 1. The roller frame 5*a* and roller 4*a* are therefore conjointly steerable about the bearing 6.

Figure 3:
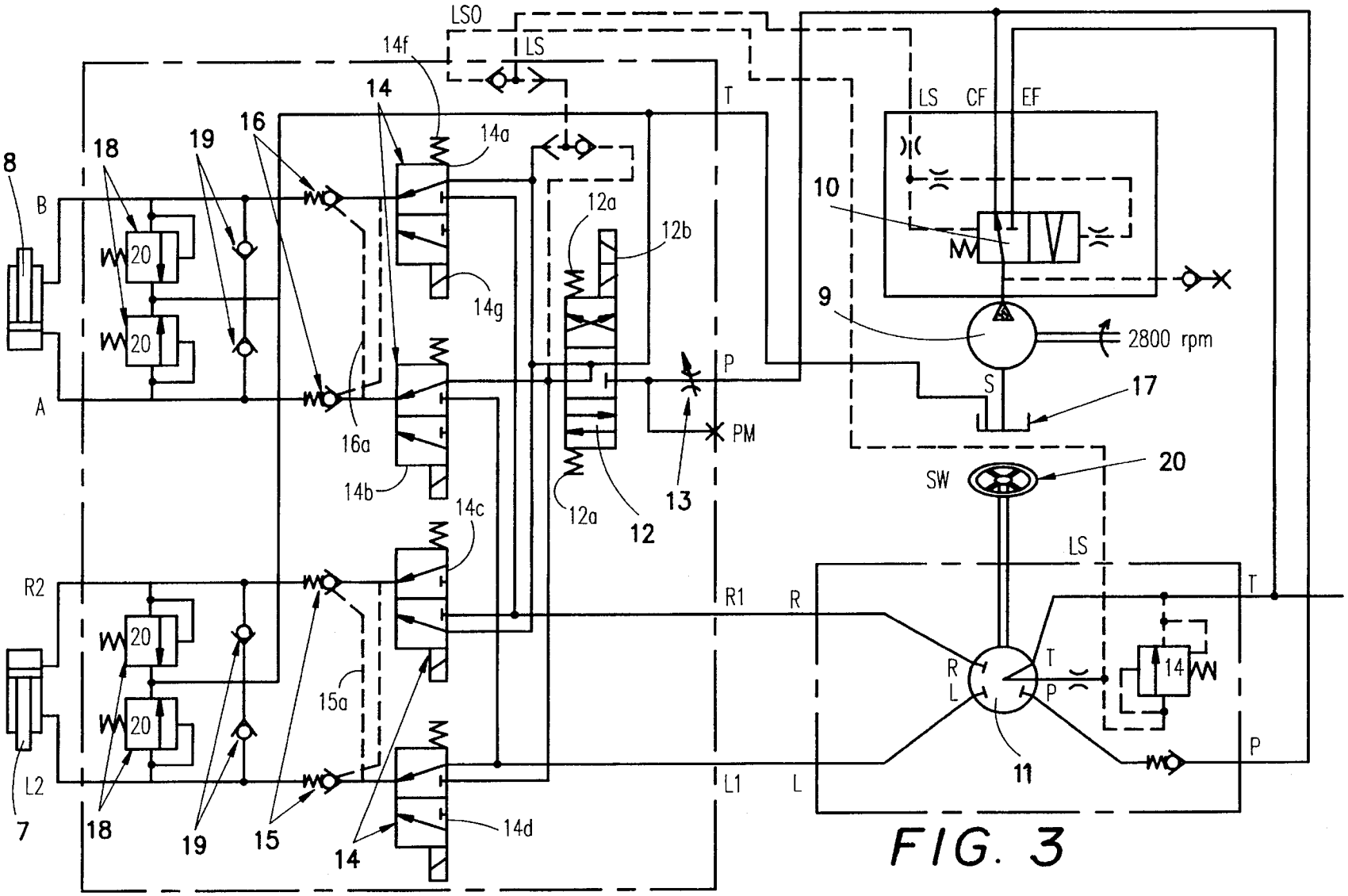
FIG. 3 is a schematic diagram of the hydraulic circuit in one embodiment of the invention; and, FIG. 4 is an electrical schematic showing how an operator-actuated changeover valve is energized via a toggle switch accessible to the operator of the machine.

FIG. 3 is the schematic diagram of the steering system hydraulics wherein the hydraulic pump 9 is equipped with a load-sensing valve 10. The pump 9 is connected via the pressure line CF to the steering-wheel activated rotary steering valve 11 and to the joystick-activated control valve 12. The steering wheel is identified by reference numeral 20. Ahead of the joystick-activated control valve 12 there is an adjustable throttle valve 13 with which an appropriate flow of fluid can be set. The steering valve unit of steering valve 11 only supplies a flow alternately to the lines R and L when the steering wheel is turned to the right and left, respectively. The flow is then proportional to the turning speed of the steering wheel. The flow through lines R and L stops when the steering wheel stops turning.

The steering valve 11 is a rotary valve which, when the steering wheel 20 is turned, affects the flow of hydraulic fluid to a degree proportional to the angular velocity at which the steering wheel is manually turned.

The joystick-activated control valve 12 is actuated by the operator via the joystick operatively connected to the control valve. The control valve 12 includes two springs 12*a* which bias the valve into the neutral position shown. The control valve 12 also includes two solenoids 12*b* which are selectively energized by the operator when he moves the joystick.

Flow through the control valve 12 is blocked when the valve 12 is not activated (neutral position shown), but when the joystick is moved to the right or left, there is a limited flow from the control valve 12 through the switching valves (14*a*, 14*b*) or switching valves (14*c*, 14*d*) depending upon whether these valve are actuated.

Each of the switching valves (14*a* to 14*d*) includes a biasing spring 14*f* which biases the valve into the position shown in FIG. 3. As soon as actuation of the joystick ceases, the joystick returns to its neutral position, whereby the electric control valve 12 also returns to its blocked, neutral position.

Figure 4:
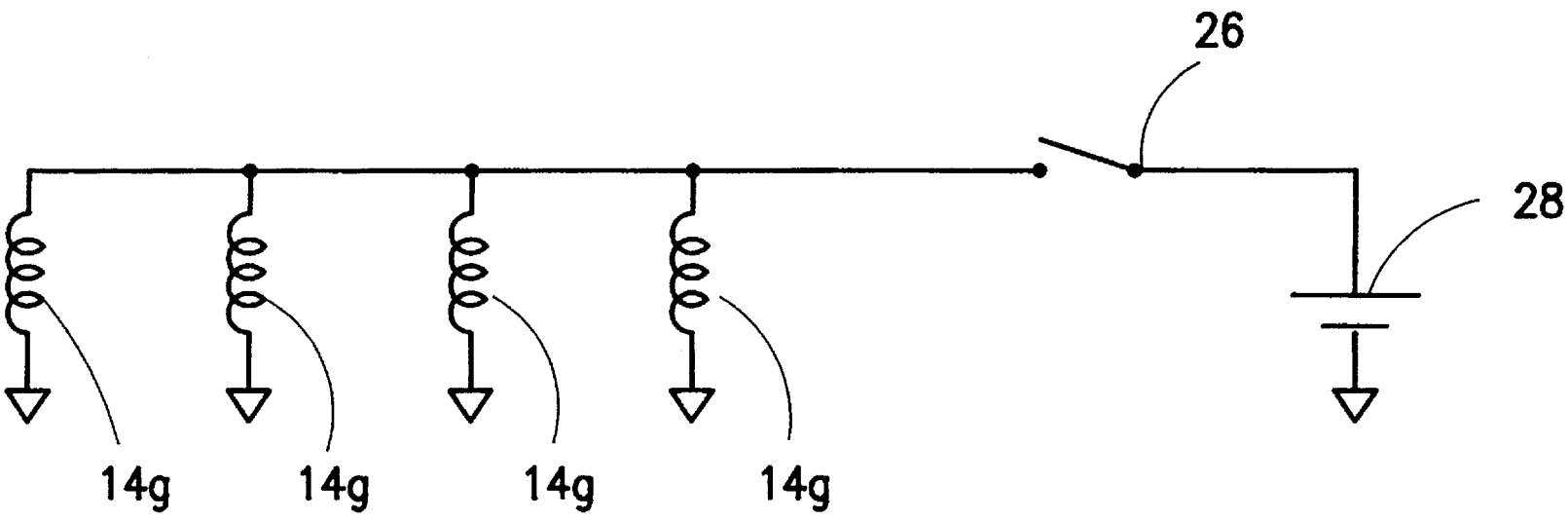

The four switching valves 14*a* to 14*d* are connected in two pairs (14*a*, 14*b*) and (14*c*, 14*d*). The first pair (14*a*, 14*b*) is connected to the roller steering cylinder 8 and the second pair (14*c*, 14*d*) to frame steering cylinder 7. The functional positions of the valves (14*a* to 14*d*) are changed, for example, by an electric toggle switch in the cab. The valves (14*a* to 14*d*) are each equipped with a solenoid 14*g* and all four solenoids are energized simultaneously when the electric toggle switch in the cab is thrown. FIG. 4 shows that when the toggle switch 26 is actuated, a voltage supply 28 is applied to the solenoids 14*g* of each of the switching valves (14*a* to 14*d*).

By means of check valves 15 having bypass connection 15*a*, fluid can flow from the nonpressurized part of the steering cylinders 7 back to the steering valve 11 via the bypass connection when the frame steering is activated. If joystick control is activated, fluid flows to the tank 17. In a corresponding manner, the check valves 16 having bypass connection 16*a* permit a return flow of oil from the nonpressurized part of the steering cylinder 8 to time tank 17. The arrangement of the frame steering system and the roller steering system with the two overflow valves 18 and the two check valves 19 is intended to prevent overloading of the steering system if an extremely heavy external load should occur, something which could happen if the rollers strike some solid object such as a curbstone or the like.

As explained above, the toggle switch has two positions. In the first position (off), the four switching valves (14*a* to 14*d*) are deenergized (the position shown in FIG. 3); whereas, in the second position (on), the four valves (14*a* to 14*d*) are energized. Frame steering (wherein frame section 1 is rotated) and roller support steering (wherein trailing roller frame 5*a* and trailing roller 4*a* are conjointly rotated about bearing 6) are available simultaneously to the operator as summarized in the following table.

| Position of operator actuated toggle switch | Switching Valves (14a to 14d) | Steering Modes |
|---|---|---|
| on | energized | Roller frame 5a and roller 4a are rotated conjointly about bearing 6 via steering cylinder 8 by operator actuation of the steering wheel and steering valve 11; whereas, trailing frame section 1 is pivoted about steering link 3 via steering cylinders 7 by operator actuation of joystick (operatively connected to control valve 12). |
| off | deenergized | Roller frame 5a and roller 4a are rotated conjointly about bearing 6 via steering cylinder 8 by operator actuation of joystick (operataively connected to control valve 12); whereas, trailing frame section 1 is pivoted about steering link 3 via steering cylinders 7 by operator actuation of steering wheel and steering valve 11. |

Generally, it is more convenient for the operator to use the rotary wheel because the steering valve 11 can deliver more hydraulic fluid more rapidly depending upon how fast the operator rotates the steering wheel. On the other hand, only a fine adjustment of steering is provided using the joystick because only a fixed amount of hydraulic fluid passes through control valve 12 because of throttle 13.

During operation of the surface compacting machine situations arise wherein it will be more convenient for the operator to actuate steering cylinder 8 via steering valve 11 utilizing the steering wheel (coarse rapid steering) while, at the same time, actuating frame steering cylinder 7 via control valve 12 utilizing the joystick (fine slow steering). Other situations will arise wherein the opposite will more adequately serve the needs of the operator in which case the operator merely needs to flip the toggle switch.

The solenoids 14*g* of solenoid actuated valves (14*a* to 14*d*), the supply voltage 28 and the toggle switch 26 conjointly define operator-actuated changeover valve means.

It is understood that the foregoing description is that of the preferred embodiments of the invention and that various changes and modifications may be made thereto without departing from the spirit and scope of the invention as defined in the appended claims.

What is claimed is:

1. A tandem surface compacting machine, comprising:

a trailing frame section including: a frame; a roller support holding roller means for compacting a surface; and, bearing means for pivotally connecting said roller support to said frame;

a leading frame section including: a frame; and, a roller support for holding roller means for compacting the surface;

a steering link connecting said leading frame section to said trailing frame section;

a first hydraulic steering assembly for pivotally actuating said trailing frame section about said steering link;

a second hydraulic steering assembly for pivotally actuating said roller support relative to said frame;

a steering wheel and steering valve unit for supplying a first quantity of hydraulic fluid;

a joystick-activated control valve unit for supplying a second quantity of hydraulic fluid;

changeover valve means interposed between said steering assemblies and said valve units; and, said changeover valve means being switchable between:

(a) a first position wherein said steering wheel and steering valve unit is hydraulically connected to said first hydraulic steering assembly and said control valve unit is hydraulically connected to said second hydraulic steering assembly; and, (b) a second position wherein said steering wheel and steering valve unit is hydraulically connected to said second hydraulic steering assembly and said control valve unit is hydraulically connected to said first hydraulic steering assembly.

2. The tandem surface compacting machine of claim 1, said changeover valve means including a solenoid actuated valve, a voltage supply for supplying a voltage and a toggle switch for applying said voltage to said solenoid actuated valve to move from said first position to said second position.

3. The tandem surface compacting machine of claim 2, said steering valve unit including a steering valve and said steering wheel is connected to said steering valve for actuating said steering valve; said steering valve being a rotary valve which, when said steering wheel is turned, affects the flow of hydraulic fluid to a degree proportional to the angular velocity at which said steering wheel is manually rotated; and, said control valve unit including a control valve and adjustable throttle means connected to said control valve to assure that an even adjustable flow of hydraulic fluid passes to said control valve.

* * * * *

UNITED STATES PATENT AND TRADEMARK OFFICE

CERTIFICATE OF CORRECTION

PATENT NO. : 5,562,175

DATED : October 8, 1996

INVENTOR(S) : Mats Björsne and Bo Svensson

It is certified that error appears in the above-identified patent and that said Letters Patent is hereby corrected as shown below:

In column 1, line 12: delete "rollers" and substitute -- rollers. -- therefor.

In column 3, line 19: delete "time" and substitute -- the -- therefor.

In column 3, line 52: delete "operataively" and substitute -- operatively -- therefor.

Signed and Sealed this

Fourteenth Day of January, 1997

Bruce Lehman

*Attest:*

BRUCE LEHMAN

*Attesting Officer*

*Commissioner of Patents and Trademarks*